US007017840B2

(12) United States Patent
Krüger et al.

(10) Patent No.: US 7,017,840 B2
(45) Date of Patent: Mar. 28, 2006

(54) INJECTION DEVICE FOR INJECTING FUEL

(75) Inventors: Grit Krüger, Regensburg (DE); Eberhard Kull, Pfaffenhofen (DE); Ferdinand Löbbering, Alteglofsheim (DE); Jürgen Schindlatz, Neukirchen b. Hl. Blut (DE); Clemens Senghaas, Leingarten (DE)

(73) Assignee: Siemens Aktiengesellschaft, Munich (DE)

( * ) Notice: Subject to any disclaimer, the term of this patent is extended or adjusted under 35 U.S.C. 154(b) by 80 days.

(21) Appl. No.: 10/680,323

(22) Filed: Oct. 7, 2003

(65) Prior Publication Data

US 2004/0112988 A1 Jun. 17, 2004

(30) Foreign Application Priority Data

Oct. 7, 2002 (DE) ..... 102 46 693

(51) Int. Cl.
*B05B 1/30* (2006.01)

(52) U.S. Cl. ..... 239/584; 239/533.8; 239/533.9; 239/533.12

(58) Field of Classification Search ..... 239/533.3, 239/533.8, 533.9, 533.12, 584
See application file for complete search history.

(56) References Cited

U.S. PATENT DOCUMENTS

| | | | | |
|---|---|---|---|---|
| 4,470,548 | A * | 9/1984 | Ushimura | 239/533.3 |
| 5,163,621 | A * | 11/1992 | Kato et al. | 239/533.12 |
| 5,221,046 | A | 6/1993 | Timmer | |
| 5,890,660 | A * | 4/1999 | Stevens | 239/533.3 |
| 6,565,017 | B1 * | 5/2003 | Fath et al. | 239/533.3 |
| 6,666,388 | B1 * | 12/2003 | Ricco | 239/533.9 |
| 6,669,117 | B1 * | 12/2003 | Boecking | 239/533.3 |
| 6,827,297 | B1 * | 12/2004 | Hockenberger | 239/533.12 |

FOREIGN PATENT DOCUMENTS

| | | |
|---|---|---|
| DE | 195 47 423 A1 | 6/1997 |
| DE | 199 31 891 A1 | 1/2001 |
| DE | 100 02 366 A1 | 8/2001 |

* cited by examiner

*Primary Examiner*—Steven J. Ganey
(74) *Attorney, Agent, or Firm*—Baker Botts L.L.P

(57) ABSTRACT

An injection device for injecting fuel comprises a nozzle needle (2), which is arranged in a nozzle body (1), and a micro-bore (10) formed in the nozzle body (1), in which at least one injection hole (8) is configured. Here one tip (3) of the nozzle needle (2) projects into the micro-bore (10) in such a way that the tip (3) is arranged at the level of the injection holes (8) in the axial direction (X—X) of the nozzle needle, with recesses being formed in the tip at the tip (3) of the nozzle needle (2) level with the injection holes (8), in order to ensure a minimum distance between the tip (3) and the injection holes (8).

13 Claims, 2 Drawing Sheets

INJECTION DEVICE FOR INJECTING FUEL

PRIORITY

This application claims foreign priority of the German application DE 10246693.9 filed on Oct. 7, 2002.

TECHNICAL FIELD

The present invention relates to an injection device for injecting fuel, in particular in a combustion chamber of an internal combustion engine.

BACKGROUND OF THE INVENTION

Various embodiments of injection devices for injecting fuel into a combustion chamber of an internal combustion engine are known from the prior art, in particular in conjunction with storage-type injection systems, such as for example common rail systems for injecting diesel fuel into a combustion chamber of an engine. Such injection devices comprise a nozzle needle guided in a nozzle body, with a seal fit being created at one tip of the nozzle needle between the nozzle needle and the nozzle body. Below the seal fit in the exit direction a number of injection holes are generally arranged, which branch off from a bore on the nozzle body and through which the fuel is injected into the combustion chamber. What are known as micro-bore nozzles are also known here, with which the area below the seal fit, from which the injection holes branch, is as small as possible.

In the case of a small needle lift, for example for a preliminary or subsequent injection, with a micro-bore nozzle poor uniform distribution of fuel or a poor jet pattern may result from the small flow cross-section between the needle and the nozzle body. This results in deterioration of combustion processes in the combustion chamber and therefore to poor levels of exhaust gas emissions from the engine. With the known micro-bore nozzles the configuration of the bore is therefore such that a cross-section before the bore has to be kept large enough, which however also results in a larger micro-bore cross-section. Such conditions mean that improvements in exhaust gas emissions are severely restricted by the relatively large volume of the micro-bore.

SUMMARY OF THE INVENTION

It is therefore the object of the present invention to provide an injection device with a micro-bore nozzle, which is simple in structure, simple and economical to produce and which has a better exhaust gas emission response.

This object can be achieved by means of an injection device for injecting fuel, comprising a nozzle needle, which is arranged in a nozzle body, and a micro-bore formed in the nozzle body, in which at least one injection hole is configured, with one tip of the nozzle needle projecting in such a way into the micro-bore, that the tip is located in the axial direction of the nozzle needle at the level of the injection holes, with recesses being formed in the tip at the tip of the nozzle needle level with the injection holes, in order to ensure a minimum distance between the tip and the injection holes.

The object may also be achieved by an injection device for injecting fuel, comprising:

a nozzle needle arranged in a nozzle body comprising a tip, a micro-bore formed in the nozzle body, in which at least one injection hole is configured, wherein the tip of the nozzle needle is located in the axial direction of the nozzle needle at the level of the injection holes, recesses being formed in the tip at the tip of the nozzle needle level with the injection holes.

The minimum distance may exist even when the throttle needle is closed and even with smaller needle lift. The minimum distance can be formed by an area lying in a plane arranged perpendicular to the axial direction, with the area between the outer periphery of the tip and all the inner edge points of the injection holes with a nozzle needle lift range between 0 and approx. 80 μm being greater than or equal to approx. 0.200 mm2. The plane may run through the uppermost edge point of the injection hole. All the injection holes can be arranged in a plane, which is perpendicular to the axial direction. The tip of the nozzle needle may have a recessed area at the level of the plane. The recessed area can be configured as a circumferential groove. The recessed area can be configured as an offset. The tip of the nozzle needle may have a conical area at the level of the injection holes, with the angle between this conical area and the axis of the nozzle needle being greater than an angle of the tip of the nozzle needle at a seal fit of the needle at the nozzle body.

The injection device according to the invention for injecting fuel into a combustion chamber is configured so that one tip of a nozzle needle extends so far into a micro-bore that in the longitudinal direction of the nozzle needle the tip is also located at the level of the injection holes. The tip of the nozzle needle at the level of the injection holes is thereby configured so that in this area it is formed in a different manner from a basic conical form, so that there is an adequate distance between the injection holes and the nozzle needle. With this minimum distance it can be ensured that the needle is always at an adequate distance from the inlet of the injection hole, so that there is a good jet pattern and good uniform distribution of the fuel before entry into the injection holes. This results in a significant improvement in exhaust gas emissions. In other words this minimum distance between the tip and the injection holes is achieved by forming recesses in the tip at the tip of the nozzle needle level with the injection holes. The recesses can be configured here in any geometrical form.

In order to achieve an improvement in exhaust gas emissions even with a small needle lift, the minimum distance between the injection holes and the nozzle needle tip exists both when the nozzle needle is closed and when the needle lift is small.

Preferably the distance is configured so that an area that lies in a plane perpendicular to the nozzle needle between the outer periphery of the tip of the nozzle needle and every edge point of the injection hole facing inward to the bore in a nozzle needle lift range between 0 and approx. 80 μm is greater than or equal to 0.200 mm2. In other words the tip in the area of the injection hole is configured so that there is a ring-shaped, surface-type area between the tip and the injection hole with a minimum cross-sectional area of 0.200 mm2 both when the nozzle needle is not in operation and also with a small needle lift up to approx. 80 μm.

It is particularly preferable for the ring area to lie in a plane that is perpendicular to the direction of movement of the nozzle needle and that runs through the topmost edge point of the injection hole(s).

A particularly good jet pattern is obtained, when all the injection holes in the injection device are arranged in a plane perpendicular to the direction of movement of the nozzle needle.

Preferably the tip of the nozzle needle in the area facing the injection holes is provided with a recess that is configured for example as a circumferential groove in the conical tip of the nozzle needle. Alternatively the recess can for example be configured by an offset, particularly a stepped offset, in the tip of the nozzle needle in the area facing the injection holes.

According to another preferred embodiment of the invention, the tip of the nozzle needle is configured so that a second conical area is configured in the area facing the injection holes. Here the angle between this second conical area and the central axis of the nozzle needle is greater than an angle of the tip of the nozzle needle, for example at a seal fit of the needle. Such a second conical area can for example be produced particularly easily by grinding the nozzle needle. It should also be noted that naturally a number of consecutive conical areas can form the tip of the nozzle needle, with the angle with the central axis of the needle increasing, the nearer it is to the end of the tip.

The present invention is used in particular with storage-type injection systems, e.g. common rail systems. According to the invention, despite a small bore volume, which generally results in poor exhaust gas emissions, a good uniform distribution of injected quantities and a good jet pattern can be obtained by means of the configuration of the needle tip according to the invention, resulting in low HC emissions. This can also result in improved mixture pattern in the combustion chamber, giving a significant reduction in exhaust gas emissions and also fuel consumption.

BRIEF DESCRIPTION OF THE DRAWINGS

The present invention is described below using preferred embodiments in conjunction with the drawings. The drawings show.

DETAILED DESCRIPTION OF THE PREFERRED EMBODIMENTS

A first embodiment of the present invention is described below with reference to FIGS. 1 and 2.

Figure 1:
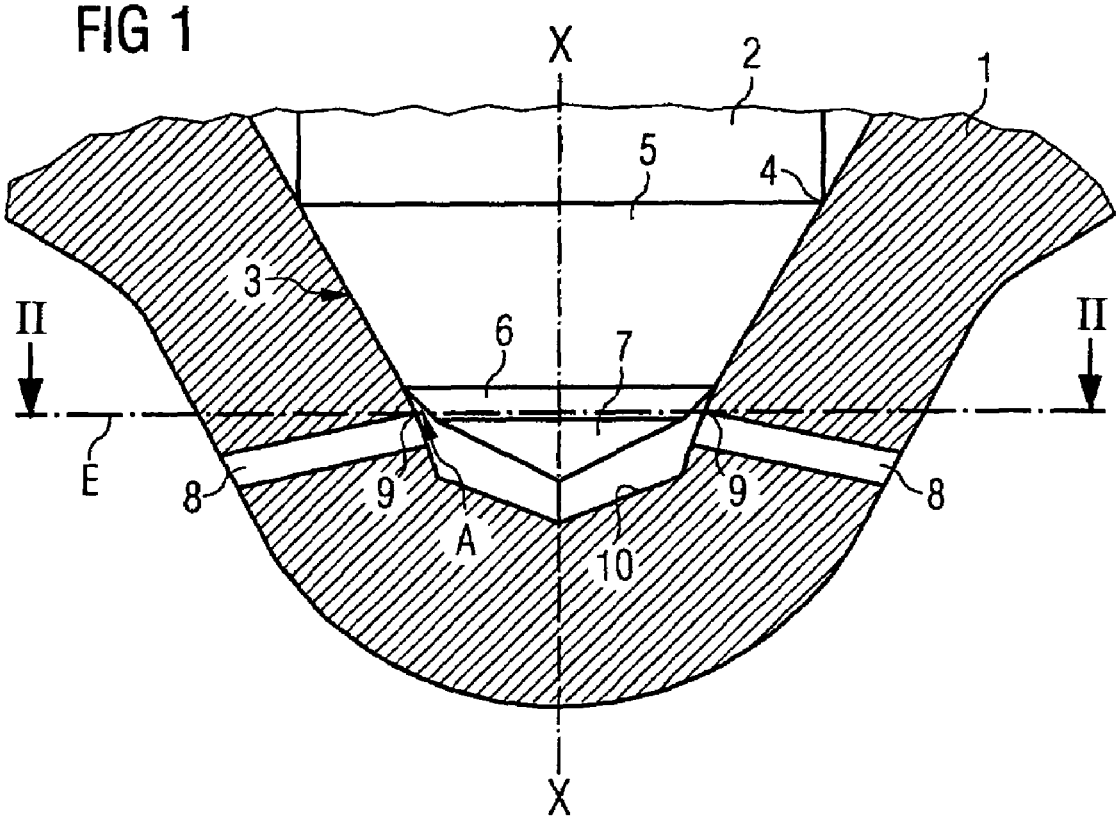
FIG. 1 a diagrammatic cross-sectional view of an injection device according to a first embodiment of the present invention, FIG. 2 a diagrammatic cross-sectional view along line II—II in FIG. 1, FIG. 3 a diagrammatic cross-sectional view of an injection device according to a second embodiment of the present invention.

As shown in FIG. 1, in the known manner the injection device comprises a nozzle needle 2 arranged in a nozzle body 1. The nozzle needle 2 rests at a seal fit 4 on the nozzle body 1 and releases or seals the seal fit, for example by activation by means of a piezo actuator, in the known manner by movement along the longitudinal axis X—X of the nozzle needle 2, to start or end an injection. The nozzle needle 2 comprises an essentially conically shaped tip 3. In the present embodiment the tip 3 is formed by a first conical area 5, a second conical area 6 and a third conical area 7. The conical areas 5, 6, 7 here are configured so that they are each at a different angle to the longitudinal axis X—X. More precisely the first conical area 5 is at the most acute angle in respect of the axis X—X and the third conical area 7 at the end of the tip 3 is at the most obtuse angle in respect of the axis X—X (see FIG. 1).

Figure 2:
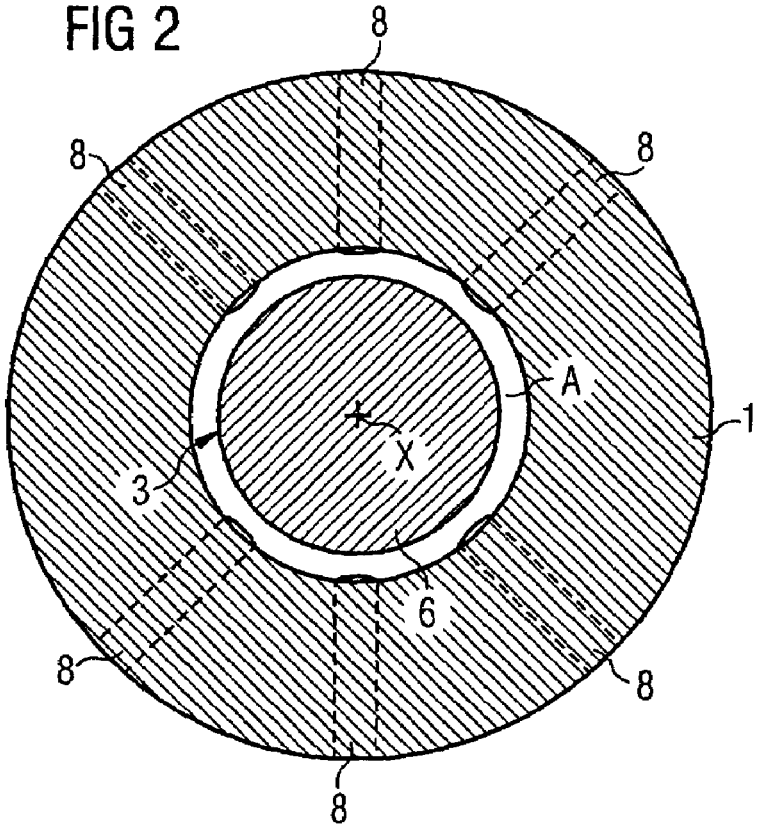

In the nozzle body 1 a number of injection holes 8, more precisely, as shown in FIG. 2, six injection holes 8 are known to be configured in a symmetrical manner. The injection holes 8 here lie on a plane perpendicular to the longitudinal axis X—X of the nozzle needle 2.

As shown in FIG. 1, the second conical area 6 faces an uppermost edge point 9 of the injection hole 8 when the nozzle needle 2 is closed and with a smaller needle lift up to approx. 80 μm. More precisely the uppermost edge point 9 lies in a plane E, that runs perpendicular to the longitudinal axis X—X of the nozzle needle 2 and the uppermost edge point 9 of the injection hole 8. This results in a ring-shaped area A between the uppermost edge point 9 and the tip 3 of the nozzle needle.

The ring-shaped area A is shown in detail in the cross-sectional view along the plane E shown in FIG. 2. The ring-shaped area A here has a size greater than or equal to approx. 0.200 mm2. This means that even when the nozzle needle is closed, a certain minimum distance is ensured between the tip 3, more precisely the conical area 6 of the tip 3 and the nozzle body 1. This means that an adequate area can be maintained before the injection holes. This also means that, even with a micro-bore nozzle as shown in FIG. 1, despite the small bore volume, a good uniform distribution of the individual injected quantities and a good jet pattern can be obtained during injection, reducing exhaust gas emissions and fuel consumption.

Figure 3:
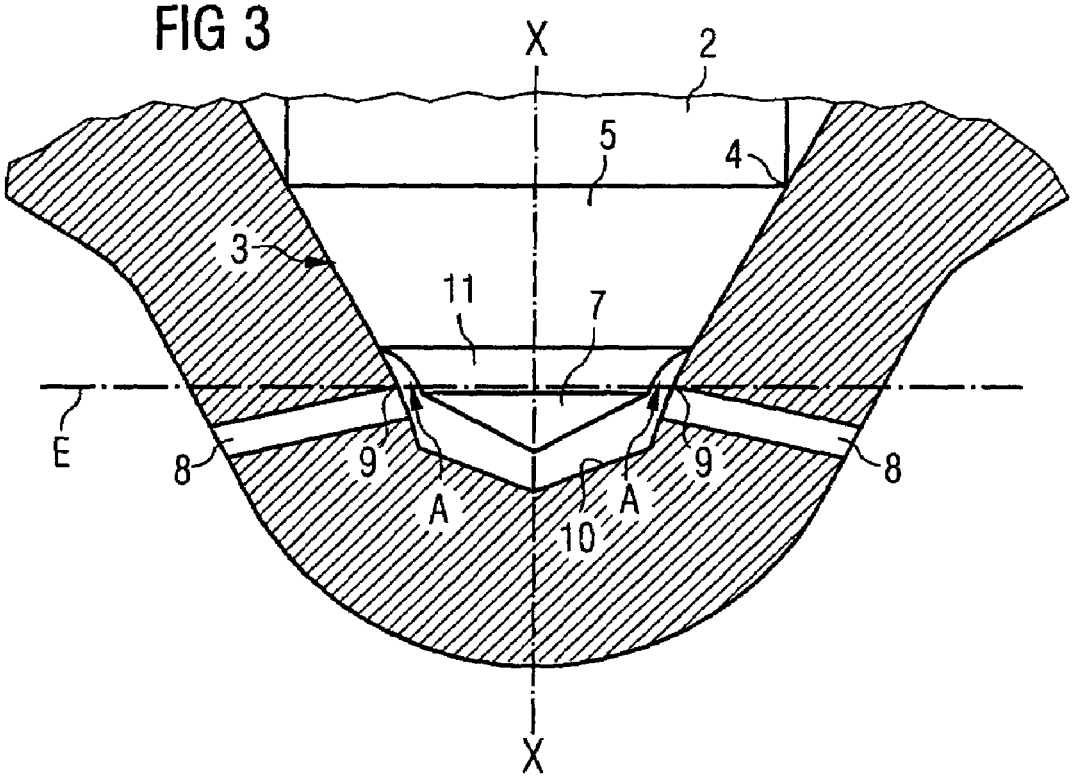

An injection device according to a second embodiment of the present invention is described below with reference to FIG. 3. Identical or functionally identical parts are referred to here with the same references as in the first embodiment.

Unlike the first embodiment, with the second embodiment the tip 3 of the nozzle needle in the area facing the injection hole 8 is formed by an approximately parabolic, tapering area 11. This tapering area 11 of the tip 3 is configured here so that an area A with a minimum cross-section of approx. 0.200 $mm^2$ results between the uppermost edge point 9 of the injection hole 8 and the tapering area 11.

This means that even when the nozzle needle is closed there is an adequate distance between the tip of the nozzle needle and the injection holes 8, so that improved injection and therefore also in particular an improved exhaust gas response on the part of the engine can be achieved. The tapering area can also be produced by grinding for example.

Otherwise the second embodiment corresponds to the first embodiment, so reference can be made to the description given for this.

The above description of the embodiments according to the present invention is only for illustrative purposes and not for the purpose of restricting the invention. Different changes and modifications are possible within the context of the invention, without departing from the scope of the invention or its equivalents.

What is claimed is:

1. An injection device for injecting fuel, comprising a nozzle needle, arranged in a nozzle body;

a micro-bore formed in the nozzle body the nozzle body having an injection hole therein, wherein a tip of the nozzle needle projects into the micro-bore;

the tip located in the axial direction of the nozzle needle at the level of the injection hole, the tip having a recess formed therein at a point level with the injection hole in order to ensure a minimum distance between the tip and an uppermost edge point of the injection hole; and the recess configured as a cirumferential groove, wherein the minimum distance is formed by an area lying in a plane arranged perpendicular to the axial direction with the area between the outer periphery of the tip and the uppermost edge points of the injection hole being greater than or equal to approximately 0.200 $mm^2$, and having a nozzle needle lift range between 0 and approximately 80 μm.

2. An injection device according to claim 1, wherein the minimum distance exists even when the nozzle needle is closed.

3. An injection device according to claim 1, wherein the plane runs through the uppermost edge point of the injection hole.

4. An injection device according to claim 1, wherein all the injection holes are arranged in a plane perpendicular to the axial direction.

5. An injection device according to claim 4 further comprising the tip of the nozzle needle having the recess at the level of the plane.

6. An injection device for injecting fuel comprising:

a nozzle needle arranged in a nozzle body comprising a tip, a micro-bore formed in the nozzle body, in which at least one injection hole is configured, wherein the tip of the nozzle needle is located in the axial direction of the nozzle needle at the level of the injection holes;

said tip having a recess at a point level with an uppermost edge point of the injection holes ; and the recess configured as a conical area at the level of the at least one injection hole, wherein a minimum distance between the tip and the at least one injection hole is formed by an area lying in a plane arranged perpendicular to the axial direction with the area between the outer periphery of the tip and the inner edge point of the at least one injection hole being treater than or equal to approximately 0.200 $mm^2$, and having a nozzle needle lift range between 0 and approximately 80 μm.

7. An injection device according to claim 6, wherein a minimum distance between the tip and the at least one injection hole exists when the nozzle needle is closed.

8. An injection device according to claim 6, wherein the plane runs through the uppermost edge point of the at least one injection hole.

9. An injection device according to claim 6, wherein the at least one injection hole is arranged in a plane perpendicular to the axial direction.

10. An injection device according to claim 9, wherein the tip of the nozzle needle has another conical area extending from the conical area.

11. An injection device according to claim 10, wherein the another conical area has a different angle than the conical area.

12. An injection device according to claim 6, wherein an angle between the conical area and an axis of the nozzle needle being greater than an angle of the tip of the nozzle needle at a seal fit of the needle at the nozzle body.

13. An injection device for injecting fuel, said device comprising:

a nozzle needle arranged in a nozzle body, the nozzle body having an injection hole therein;

a micro-bore formed in the nozzle body, the micro-bore having a tip of the nozzle needle projecting into the micro-bore, the tip located in the axial direction of the nozzle needle at the level of the injection hole, the tip having a recess formed therein at a point level with the injection hole in order to ensure a minimum distance between the tip and an uppermost edge point of the injection hole; and the recess configured as a conical area at the level of the injection hole, wherein the minimum distance is formed by an area lying in a plane arranged perpendicular to the axial direction, with the area between the outer periphery of the tip and the uppermost edge point of the injection hole being greater than or equal to approximately 0.200 $mm^2$, and having a nozzle needle lift range between 0 and approximately 80 μm.

* * * * *